United States Patent [19]

Huber et al.

[11] Patent Number: 4,615,151

[45] Date of Patent: Oct. 7, 1986

[54] METHOD FOR MANUFACTURING OF GRINDING WHEEL

[75] Inventors: Johann Huber, Kramsach; Otto Thanner, Schwaz, both of Austria

[73] Assignee: Tyrolit Schleifmittelwerke Swarovski K.G., Austria

[21] Appl. No.: 678,983

[22] Filed: Dec. 6, 1984

[51] Int. Cl.[4] ..... B24D 3/00

[52] U.S. Cl. ..... 51/293; 51/298

[58] Field of Search ..... 51/293, 298

[56] References Cited

U.S. PATENT DOCUMENTS 3,846,360 11/1974 Needham ..... 524/525

FOREIGN PATENT DOCUMENTS 2632652 2/1977 Fed. Rep. of Germany .

2610580 9/1977 Fed. Rep. of Germany .

*Primary Examiner*—Paul Lieberman

*Assistant Examiner*—Willie J. Thompson

*Attorney, Agent, or Firm*—McGlew and Tuttle

[57] ABSTRACT

To manufacture a sound absorbing grinding wheel, vibration damping foils (2) and zones of the grinding compound forming the grinding layers (1) are alternately inserted or poured into a mold (5) and compressed. The obtained grinding wheel blank (7) is cured in a furnace at temperatures from 150° C. to 200° C. The foils (2) are of butyl rubber.

6 Claims, 5 Drawing Figures

METHOD FOR MANUFACTURING OF GRINDING WHEEL

BACKGROUND OF THE INVENTION

Field of the Invention

This invention relates generally to the construction of grinding wheels and, in particular, to a new and useful method of making such grinding wheels.

The invention relates particularly to a method of manufacturing a grinding wheel with at least two, preferably more, grinding wheels, always enclosing a non-abrasive, vibration damping layer, preferably of a polymer therebetween, and at least one reinforcing tissue, with a grinding mixture of abrasive grains, a binder, preferably a phenolic resin, and of preferably abrasive and/or non-abrasive filler materials being mixed, placed in a mold, and then cured at temperatures between 150° C. and 200° C.

It is known that while using high speed offhand grinding bodies, annoying excessive noise is produced which is caused by vibrations of the driving machine (transmission, cooling fan), of the grinding wheel, and of the treated workpiece.

The noise is so great that damage to personnel's hearing occurs. Impaired hearing cases of first compensations for occupational illness was 91% in the metal working industry within the period from 1971 to 1980. This also prompted efforts to reduce noise produced during offhand grinding.

German OS's Nos. 2610580 and 2632652 disclose sound-deadened grinding wheels comprising at least one damping layer connected to the grinding layer made of a highly attenuating material; more particularly, they provide a polymer layer having a Shore A hardness of less than 90 and a loss factor of at least 0.25.

The failure of those wheels to prevail in practice was predicated on reasons of economy, namely on the fact that their manufacture was too expensive.

Basically, the mentioned references provide a plurality of individual grinding wheels or discs which have to be manufactured separately and then assembled and cemented together by means of a polymer. The problem then is to apply the polymer uniformly in a manner to prevent it from oozing out in the area of the bore and at the periphery during the subsequent assembly of the grinding disc or individual grinding wheels.

SUMMARY OF INVENTION

The present invention is directed the a method permitting to manufacture of a sound absorbing grinding wheel in an economical way.

To this end and in accordance with the invention, foils are used to form the damping layers. The foil or foils are introduced alternately with the grinding mixture into a common mold and compressed to the desired dimension of the grinding wheel to be manufactured, and then the grinding blank thus obtained is cured in a furnace.

Advantageously, it is provided that the foils to be used are lined with a reinforcing tissue. The reinforcing tissue may be a conventional one, such as employed in the manufacture of grinding wheels, of glass fiber, for example. Separate reinforcing tissues not connected to the foils may of course also be provided and inserted simultaneously with grinding layers or subsequently. As to the mixture for the foils, it is advantageously provided to use butyl rubber as the polymer component.

One kinds of rubber (such as nitrile rubber, natural rubber, synthetic rubber, styrene butadiene rubber, or their combinations) may also be employed of course.

It must be taken into account that the used foils are to withstand temperatures produced in a furnace during the curing of the wheel, namely of from 150° C. to 200° C.

With foils of this thickness, best test results were obtained as to the relation between the sound absorption and the grinding performance.

Another embodiment of the invention provides that after being removed from the mold, the grinding wheel blank is held tight between clamping plates.

Aside from the economical manufacture of the grinding wheel, one of the substantial advantages of the invention is the satisfactory bond between the sound absorbing foils and the adjacent grinding layers.

This satisfactory bond makes sure that during the grinding the cover layer of the grinding wheel (=the set off side of the wheel) abrades regularly, and no braking or sputtering away of grain clusters occurs.

In the following, the invention is comprehensively described with reference to the accompanying drawings.

GENERAL DESCRIPTION OF THE PREFERRED EMBODIMENTS

Figure 1:
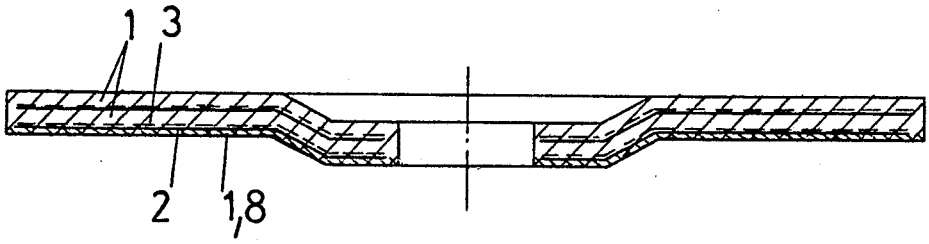
FIGS. 1 and 2 show each a diagrammatical sectional view of an inventive grinding wheel.
Figure 2:
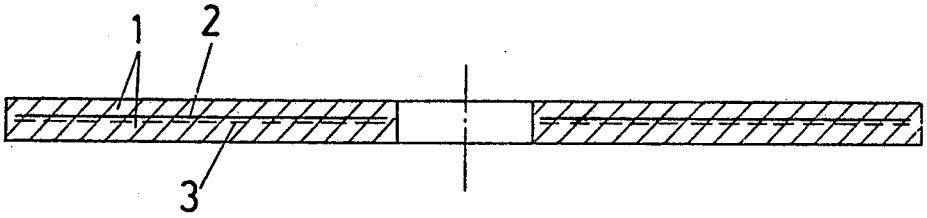

As shown in FIGS. 1 and 2 a grinding wheel manufactured in accordance with the inventive method comprises a plurality of grinding layers 1 which contain abrasive grains, a binder, particularly a phenolic resin, and filler materials, if provided, and at least one, preferably more, damping layers formed by foils 2 of a polymer, preferably butyl rubber.

Figure 3:
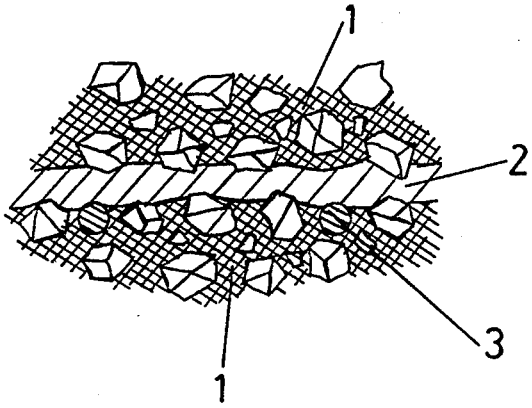
FIG. 3 is an enlarged partial section of a grinding wheel at a damping layer, FIG. 4 diagrammatically illustrates the filling of the grinding mixture and inserting of the damping foils into the mold, and FIG. 5 diagrammatically shows the clamping of grinding wheel blanks between clamping plates.
Figure 4:
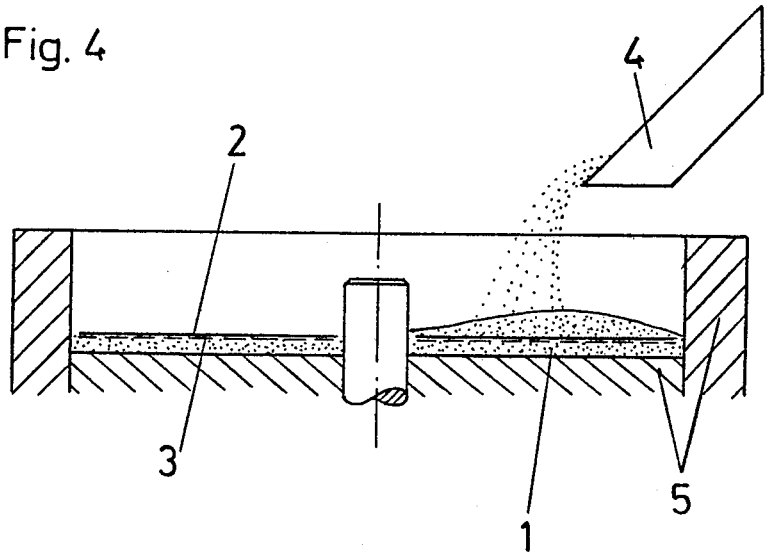
Figure 5:
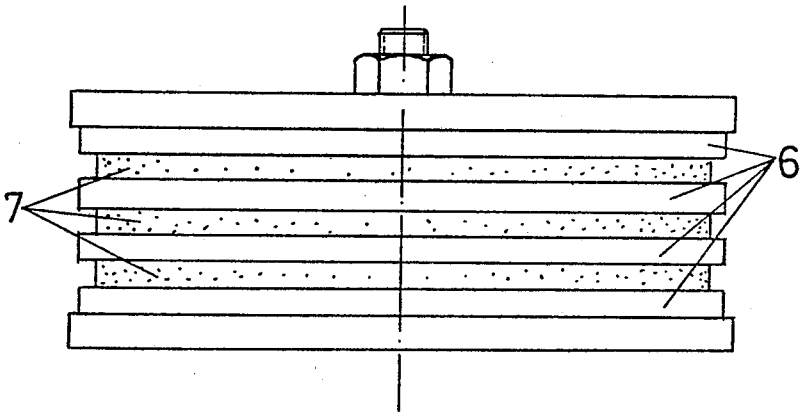

In the embodiment shown in FIG. 3, a reinforcing tissue 3 is applied as a lining to foil 2.

The grinding wheel is manufactured as follows:

Into a conventional mold 5, a layer 1 of a grinding mixture is poured and flattened or vibrated smooth, whereupon a foil 2 lined with a reinforcing tissue 3 is inserted. Then, grinding mixture 4 is poured on again, to form the next grinding layer 1, and again a foil 2 may be placed thereon. The procedure is repeated until a grinding wheel blank 7 having the desired number of grinding layers 1, foils 2, and reinforcing tissues 3 is obtained.

Thereupon, foils 2, reinforcing tissue 3, and grinding layers 1 of the grinding wheel mixture 4 are compressed in mold 5, to obtain a grinding wheel blank 7 having the desired dimensions.

After removing grinding wheel body 7 from mold 5, the blank is tightened firmly between clamping plates and, after some period of seasoning, if provided, cured in a furnace.

Clamping plates 6 are comformable to the finished grinding wheel and are to ensure the accuracy in shape and dimension thereof.

The inserted foils 2 have no apertures in the area of the grinding layers.

The following is a recipe for one embodiment of a foil to be used in the inventive method:

| | Proportion in Mass |
|---|---|
| Bromine Butyl Rubber | 100 |
| Zinc oxide, active | 2 |
| Siliceous filler (about 85% of $SiO_2$) | 40 |
| Phenolic resin | 25 |

The following is a recipe for a grinding wheel mixture to be employed in the inventive method:

| In Percent by Volume | |
|---|---|
| Volume of grains | 35% |
| Volume of binder | 25% |
| Volume of reinforcements and foils | 23% |
| Volume of voids | 17% |
| Curing time . . . 20 hours | |
| Curing temperature-160° C. | |

Without departing from the scope of the invention the foils 2 and the reinforcing tissue 3 may be introduced into mold 5 separately of course.

We claim:

1. A method of manufacturing a grinding wheel with at least two grinding layers and using a mold, comprising directing into the mold a granular pourable grinding material forming grinding layers and composed of a grinding mixture of abrasive grains, a binder of resin and a filler, also directing alternately with the grinding layers layers of reinforcing damping foils, compressing the layers to be desired dimension for the grinding wheel so as to form a grinding wheel blank, and then curing the blank in a furnace at a temperature of between 150° C. to 200° C.

2. A method according to claim 1, wherein said foils are lined with a reinforcing tissue material.

3. A method according to claim 1, wherein said foils comprise a butyl rubber material.

4. A method according to claim 1, wherein the foils have a thickness of between 0.4 mm and 1 mm.

5. A method according to claim 2, wherein said foils have a thickness of from 0.5 mm to 0.7 mm.

6. A method according to claim 1, including inserting a foil as a cover of the materials in the mold.

* * * * *